US006347592B1

(12) United States Patent
Gessert

(10) Patent No.: US 6,347,592 B1
(45) Date of Patent: Feb. 19, 2002

(54) MODULAR WORKBENCH AND KIT THEREFOR

(76) Inventor: Roy E. Gessert, 10150 Stern Ave., Cupertino, CA (US) 95014

( * ) Notice: Subject to any disclaimer, the term of this patent is extended or adjusted under 35 U.S.C. 154(b) by 0 days.

(21) Appl. No.: 09/006,427

(22) Filed: Jan. 13, 1998

(51) Int. Cl.[7] ..... A47B 13/00

(52) U.S. Cl. ..... 108/157.16; 108/158.11; 108/159.11

(58) Field of Search ..... 108/155, 157.13, 108/157.16, 158.11, 186, 185, 1.01, 92; 248/165, 188, 151, 150; 211/186, 189

(56) References Cited

U.S. PATENT DOCUMENTS

| | | | | | |
|---|---|---|---|---|---|
| 1,846,305 | A | * | 2/1932 | Brooks | 403/383 |
| 2,349,541 | A | * | 5/1944 | Earle | 312/198 |
| 2,380,379 | A | * | 7/1945 | Attwood | 211/189 |
| 2,659,649 | A | * | 11/1953 | Kump, Jr. | 248/151 |
| 3,105,976 | A | * | 10/1963 | Roché | 108/156 |
| 4,630,550 | A | * | 12/1986 | Weitzman | 108/155 |
| 4,691,885 | A | * | 9/1987 | Lawrance | 248/165 |
| 4,892,043 | A | * | 1/1990 | Schulz | 108/91 |
| 5,016,765 | A | * | 5/1991 | Leonardo | 211/189 |
| 5,579,703 | A | * | 12/1996 | King | 211/189 |

FOREIGN PATENT DOCUMENTS

| | | | | |
|---|---|---|---|---|
| FR | 1142685 | * | 4/1957 | 108/185 |
| FR | 1183130 | * | 7/1959 | 108/101 |
| GB | 231231 | * | 3/1925 | 403/383 |

* cited by examiner

*Primary Examiner*—Peter M. Cuomo
*Assistant Examiner*—Jerry A. Anderson
(74) *Attorney, Agent, or Firm*—John J. Leavitt

(57) ABSTRACT

Presented is a simplified modular free-standing workbench including a pair of laterally spaced and parallel workbench-top support members to which a workbench top is rigidly yet detachably secured by quick-connect/disconnect fastener elements. Pairs of tubular steel legs rigidly yet detachably engage the associated ends of the tubular bench top support members. Foot members are rigidly yet detachably engaged with the bottom ends of the leg members to enable height adjustment. Transversely extending tubular members rigidly yet detachably engage the confronting surfaces of the laterally spaced top support members by quick-connect/disconnect fastener elements to maintain their parallelism. An auxiliary shelf may be rigidly yet detachably mounted on the workbench by an auxiliary shelf support framework supermimposed over the workbench and secured thereto by quick-connect/disconnect fastener elements. One end of an assembled modular workbench may be detachably connected to an associated end of an adjacent assembled modular workbench by an interconnecting tubular extension member mounted rigidly yet detachably between the parallel transverse members so as to impose a cinching force that draws the end edges of the associated workbenches together to form a continuous line or series of two or more free-standing modular workbenches.

8 Claims, 12 Drawing Sheets

Fig_1
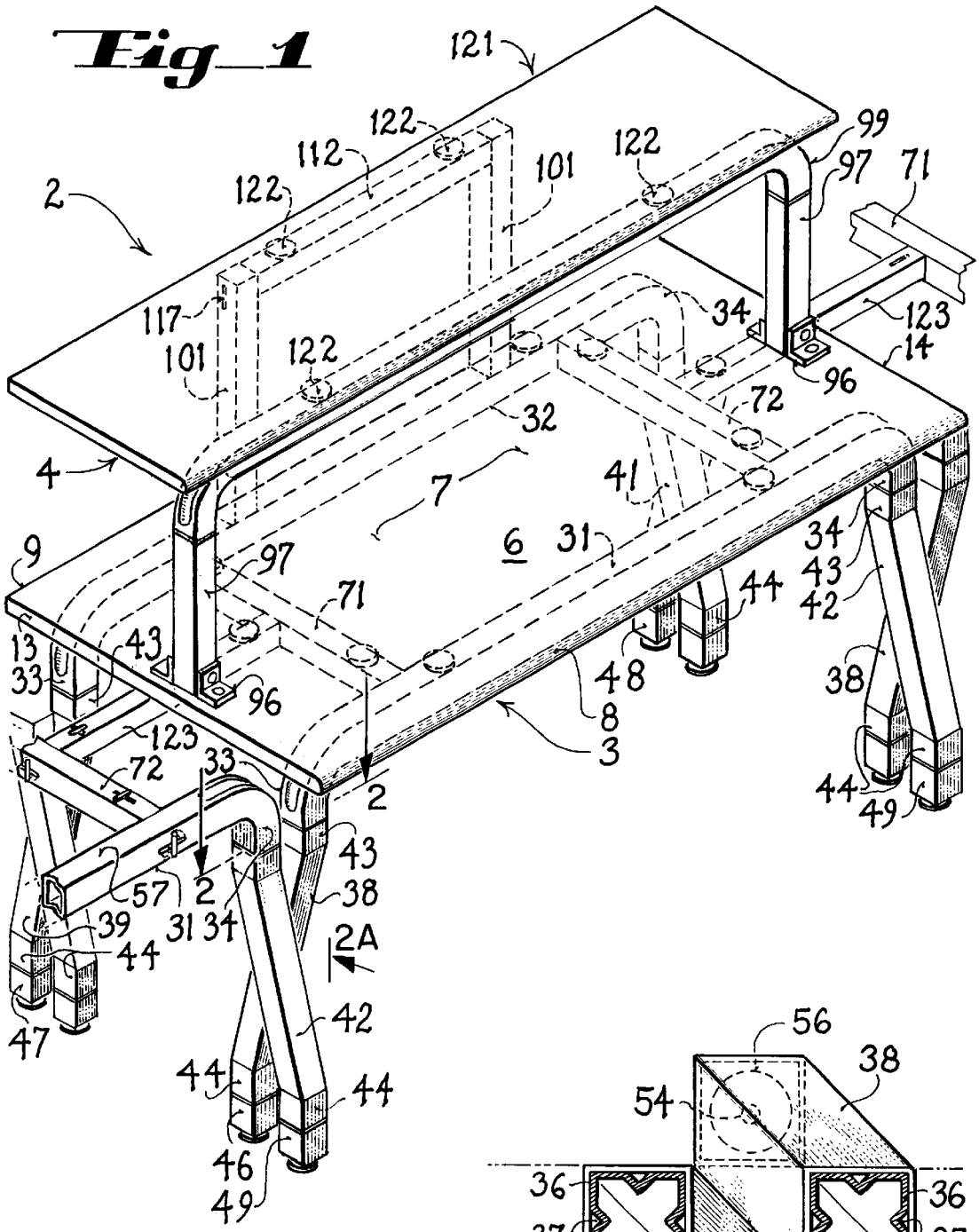
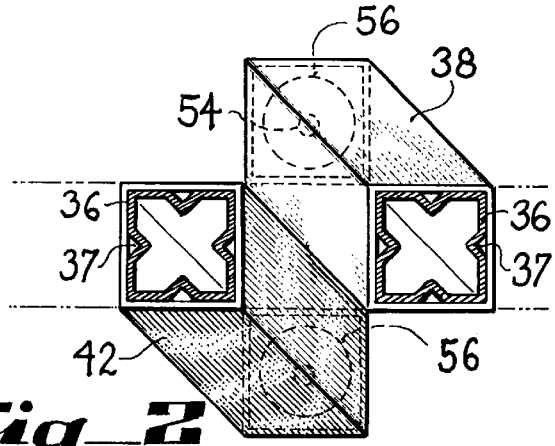
Fig_2

Fig 2A
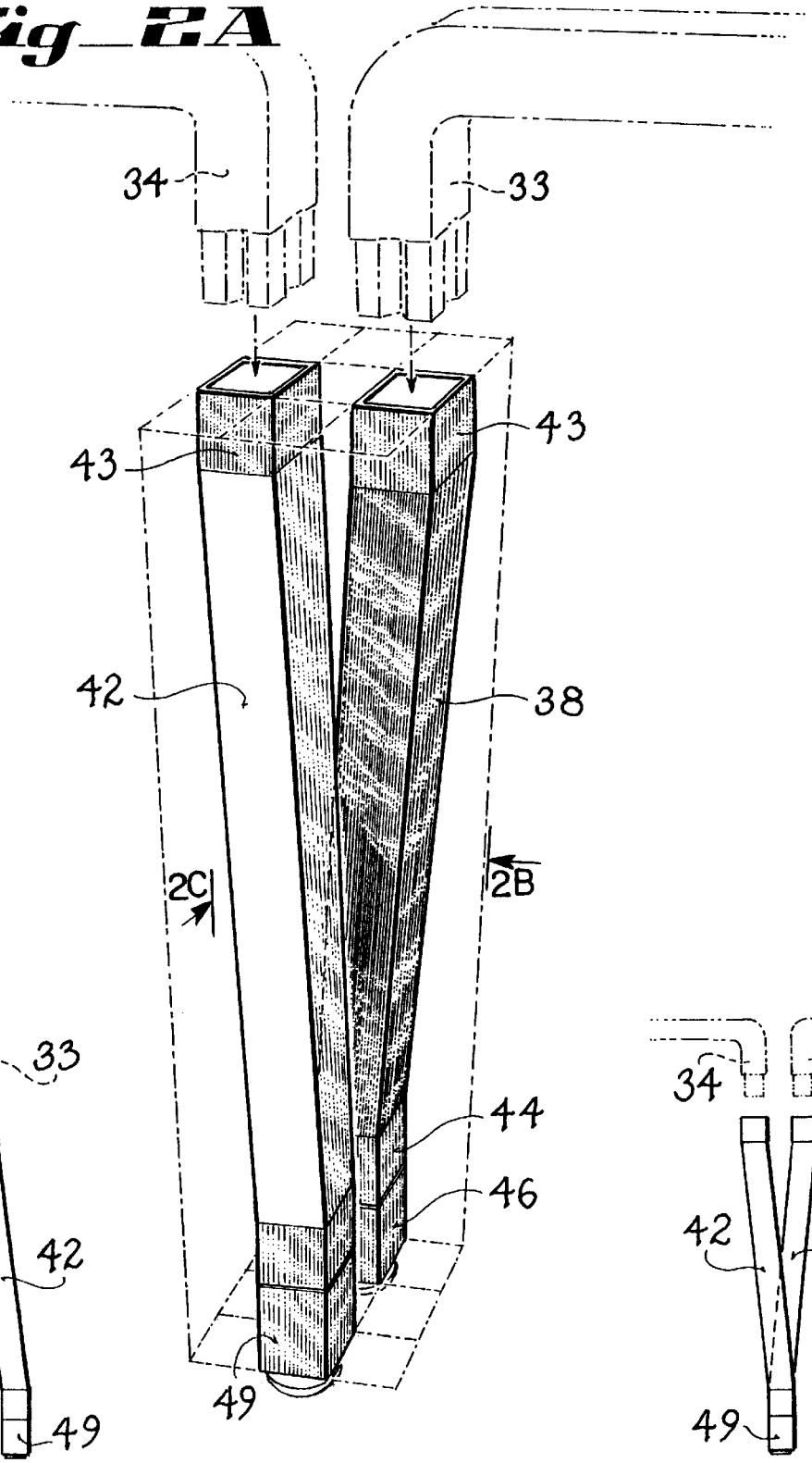
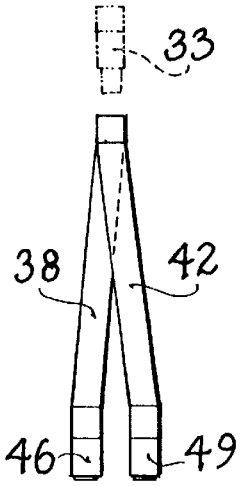
Fig 2B
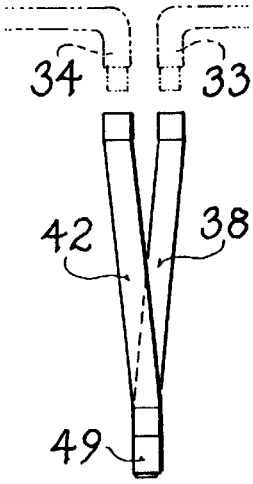
Fig 2C 34
37
36
31
82
57

84
83
84
83
81
57
31
36
37
33

Fig_15
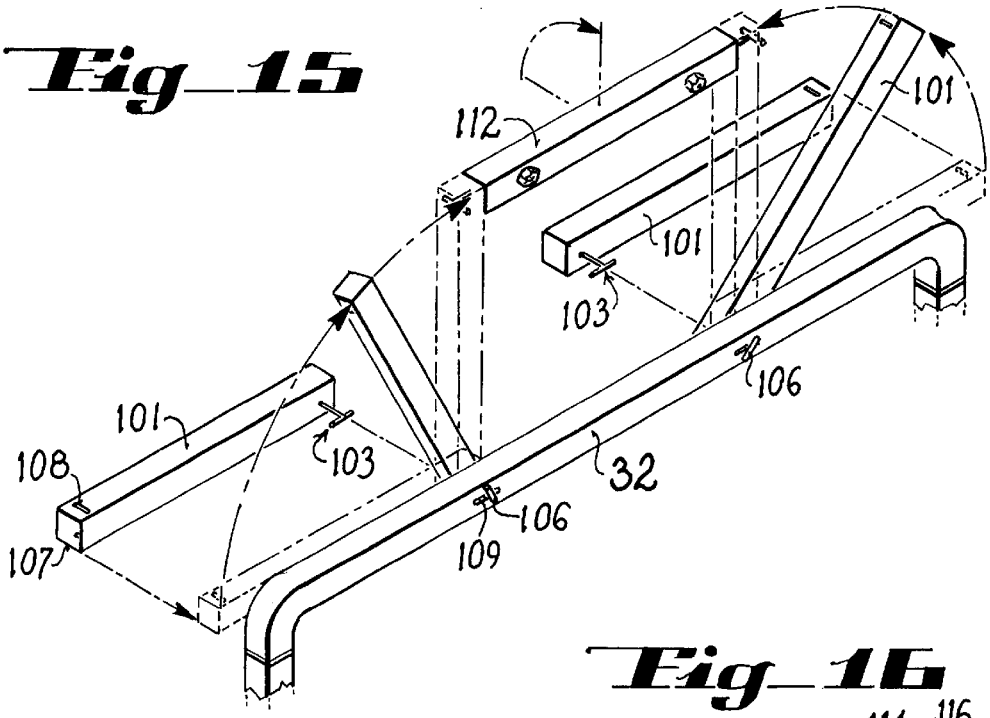
Fig_16
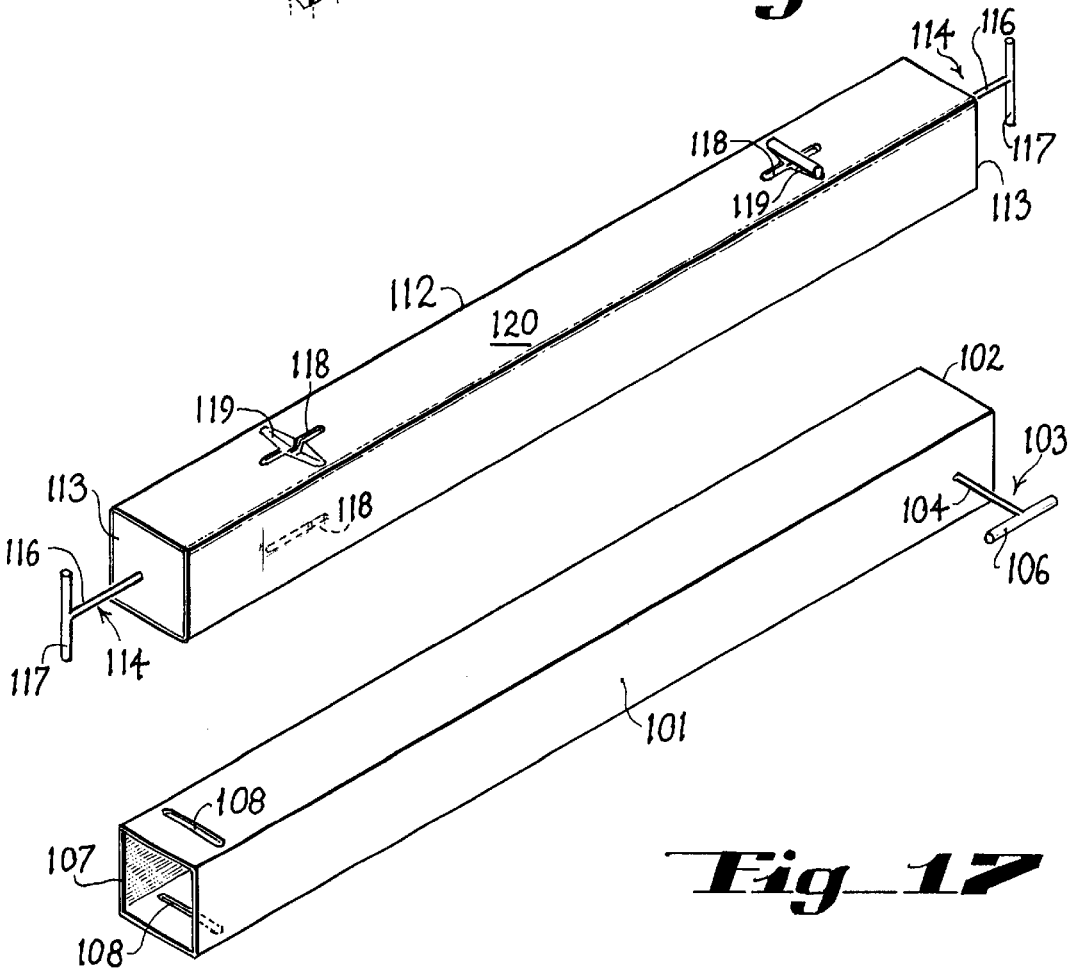
Fig_17

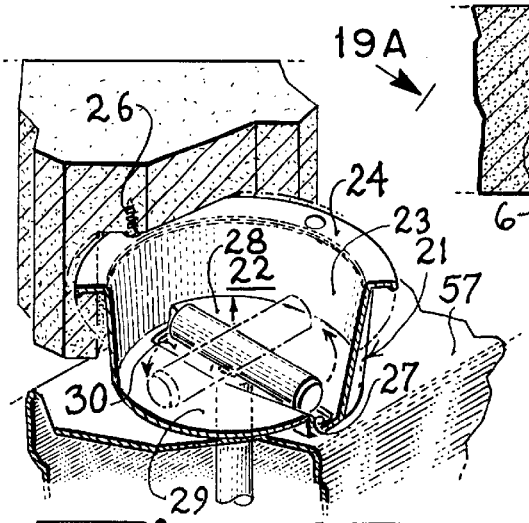
Fig_19A
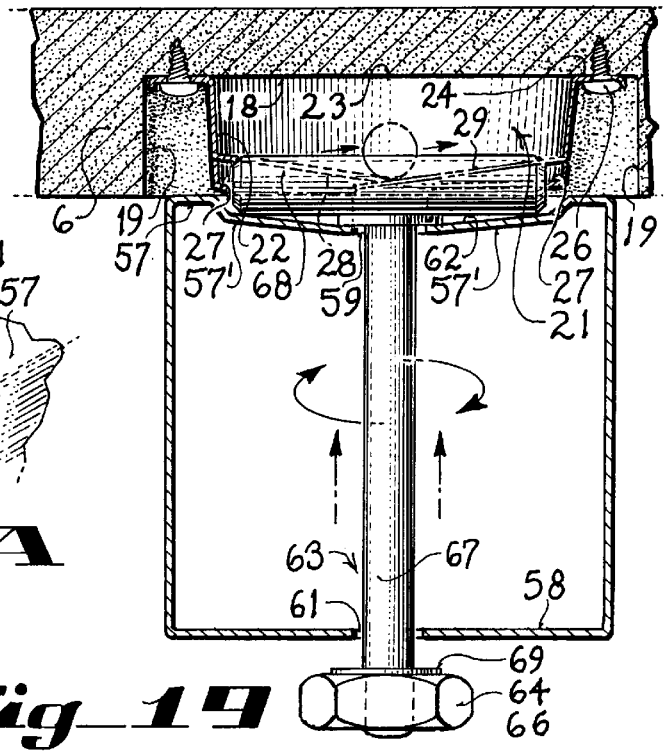
Fig_19
Fig_20
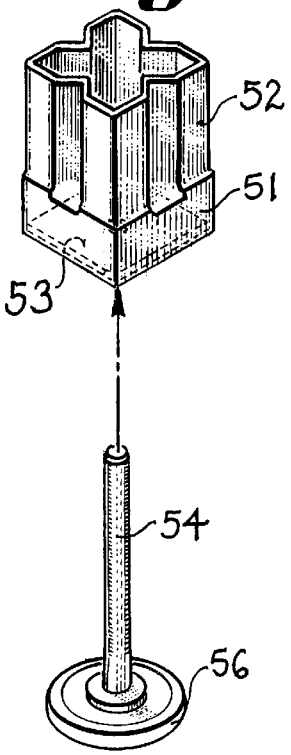
Fig_21
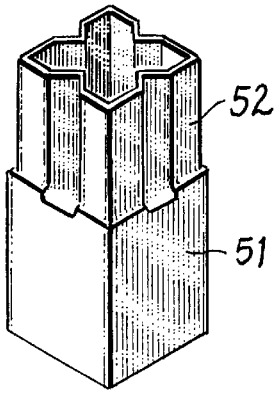
Fig_22
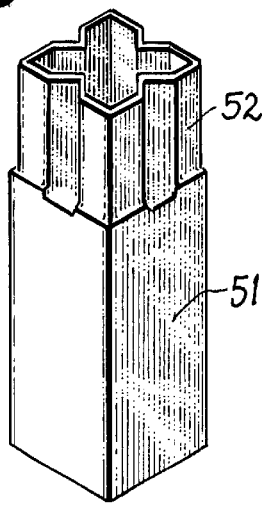

MODULAR WORKBENCH AND KIT THEREFOR

BACKGROUND OF THE INVENTION

1. Field of the invention

This invention relates to work benches in general, and particularly to a free-standing modular workbench that may be utilized as a single unit or interconnected with multiple like units to form an elongated series of cooperatively interconnected free-standing modular workbenches.

2. Description of the prior art

There has been a long felt need for a free-standing modular workbench that can be quickly assembled with no or a minimal amount of hardware or fastening devices and from only a few pre-fabricated parts or components some of which are interchangeable, and which, unlike fully welded benches or bench frames, may be compactly crated in disassembed form for shipping purposes to minimize shipping space, and which upon reaching an ultimate destination where it is to be assembled, may be quickly and accurately assembled by relatively unskilled labor, thus further minimizing the ultimate cost of the modular workbench to the consumer.

Workbenches are used in many different industries for many different purposes. Some of these purposes include the progressive build-up assembly of many different end items. In some instances, a workbench needs to be a stand-alone unit, while in other instances, one, two or several workbenches need to be interconnected to form an elongated series of indefinite length of multiple free-standing modular workbenches as required by the particular industry. This modularity enables efficient use of floor space, promotes greater production efficiency, and facilitates the assembly of multiple individual benches in various selected patterns of interconnection wherein varying bench heights and lengths may be accommodated as necessary.

It is a common perception that most workbenches are either welded or bolted together to form a single stand alone unit, not intended to be moved, disassembled or stored after being placed into service. Therefore, the conventional design of benches by bench manufacturers is a durable, though heavy, unitized structure. However, the ever changing needs of most manufacturing, assembly or industrial facilities dictate the moving, rearranging, increasing, decreasing or customizing of the height and width of work areas and specifically work benches. As a consequence, much time and labor is expended unbolting, re-bolting, re-configuring and moving heavy unitized structures. It is usually more expensive to modify the height or width of a conventional workbench, as work needs change, than it is to buy a new bench. When this occurs, the old bench becomes obsolete and is scrapped, or sold to company employees, primarily because, in the event a bench with the dimensional qualities of the old bench is not needed elsewhere, it is too expensive to store due to the space it will occupy because of its unitized cubic volume.

Additionally, many bench manufacturers do not accurately assess the needs of their customers. Benches which become obsolete at one facility are not usually centrally pooled for re-distribution and future use at another facility. One reason for this is the disproportionate and excessive cost of space in which to store the assembled but as yet undistributed workbenches. Another reason is that benches are of such varied design, color and quantity, that when re-installed in another facility, they would make that facility look like patchwork rather than appear as a wholly integrated and well thought-out organized manufacturing or assembly facility.

It is therefore understandable why the current bench provisioning industry does not base its products and production on a design standard. Not doing so unfortunately results in a burdening of the World's economy due to the waste and inefficiencies generated by obsolete, or excess benches, as well as the intensive skilled labor required to assemble or disassemble bolt-together benches, the excessive cost in fuel and time to distribute or move a fully welded bench, the frustration of the cutomer when he has to wait six weeks for a fully welded bench to be custom made, which, when after a period of time and use, much to his surprise and disappointment, the entire cost of the bench is lost because the bench cannot be effectively or economically modified to meet ever-changing needs, or it is too costly to store because it cannot be disassembled to minimize its volume and therefore its storage costs, and because no one else wants it because of its unique appearance, i.e., it does not match the style of bench already installed in another facility, and therefore additionally burdening the economy in wasted time and money because the bench is now a liability, its disposal evermore consuming our natural resources.

Furthermore, individual conventional benches which need to be arranged and maintained in an elongated series of multiple workbenches, to form a continuous unbroken work surface as required by a particular industry, must additionally be interconnected, fastened together, or secured to the floor by skilled labor to maintain their unbroken association, again adding to the cost the consumer ultimately pays for products which are more efficiently assembled on a continuous unbroken work surface. The characteristic which enables multiple work benches to be easily interconnected, forming an unbroken continuous work surface is a still further novelty of the present invention.

Furthermore, upon thorough dissection and scrutiny of the conception and life cycle of a conventional workbench, it will be understood that there is a need for an efficiently manufacturable workbench, one which can be produced, stored and distributed in a timely manner. A three foot high by three foot wide by six foot long conventional welded bench cannot be shipped disassembled, and occupies fifty-four cubic feet of space in its finished ready-to-deliver form.

By contrast, the modular workbench of the present invention can be shipped in disassembled form, and in disassembled form, occupies only four cubic fee of space, or fully thirteen times less space than required to ship or store a fully welded conventional bench. It is therefore obvious that a modular workbench according to the present invention can be produced at the same rate as a welded bench in a facility that is at least one-thirteenth the size needed to produce a conventional welded bench.

Because of the sheer size of the conventional welded bench, the labor force to produce the bench must fluctuate with the varying demand for benches, exclusively because to manufacture conventional benches of this type on a continuous production line, and store them when completed, would necessitate a facility of such size, employee number and cost overhead (operating cost) as to make the bench too costly to be afforded, than if a welded bench were produced in a facility wherein the labor does vary. However, varying the labor force to meet demand causes disruption as new workers are trained and skilled workers look elsewhere for a more stable income. Therefore, the time it takes to manufacture a bench increases as manufacturers attempt to balance the cost of their work force, overhead and ultimately the sale price of the bench to maintain their competitiveness and stay in business.

As can be understood from the situation described above, the greater the demand for benches the longer it takes to receive one at an affordable price. However, this condition is the opposite of the needs of the bench consumers who want benches when they need them and at an affordable price so that they may meet the varying demands of consumers of the products and make a profit so as to stay in business. The result of associated business entities struggling to meet bench supply and demand at a reasonable price while still making a profit, creates a stress that ever increases the cost of products and consumes time and natural resources as the pressure mounts to deliver products on time and meet contractual commitments, and wherein ultimately, the bench becomes unwanted scrap at a landfill.

When reduced to its basic elements, it can be seen that the current means and methods of providing a bench on which work is performed and products are produced, are nothing more than an intensive, inefficient and elaborate process for generating scrap. By contrast, a goal of the invention disclosed and illustrated herein is to provide a modular workbench structure of lasting value that can be used over and over again, as if it were a carpenter's hammer, available when needed, stored or sold when not needed, easily transported from work site to work site, of standard design and size to enable anyone to use it as a tool and of such reasonable price and manufacturability as to make it as affordable and readily available as an everyday necessity. The modular workbench of the instant invention thus constitutes a structure which by design achieves efficient use of time and the thoughtful and appropriate allocation of natural resources.

A preliminary patentability and novelty search has revealed the existence of United States Design patents as follows:

| | | |
|---|---|---|
| D-230,801 | D-346,709 | D-357,147 |
| D-367,537 | D-372,135 | D-279,736 |

Since none of the patents listed above disclose or even suggest the advantages and conveniences inherent in the free-standing modular workbench disclosed herein, it is accordingly one of the objects of the present invention to provide a modular workbench that utilizes standard components some of which may be interchanged one with another, and which may be engaged one with another through use of quick-connect/disconnect fastener elements to form a selectively variable height workbench that may be assembled substantially without use of tools, and which incorporates a means for adding an auxiliary or ancillary shelf above the workbench top surface for storage of tools or materials used in the manufacturing or assembly function for which the workbench is utilized.

Not infrequently, conventional workbenches utilize materials that are exceedingly heavy, that are awkward to crate and which utilize expensive shipping space when shipped from the manufacturer of the workbench to the distributor or end user. Accordingly, another object of the invention is the provision of a modular workbench incorporating elements or components that when disassembled may be shipped in a relatively shallow container that occupies minimum space and therefore minimizes the cost of shipping from point of origin to point of use.

Some manufacturing and/or assembly procedures are performed consecutively at separate work stations that are in close proximity to one another. This enables a manufacturing sub-assembly, for instance, to move from one work station to the next succeeding work station for additional manufacturing or assembly procedures. Accordingly, it is another important object of the present invention to provide a modular free-standing workbench structure that facilitates the interconnection of one workbench with another substantially without the use of tools, yet in a manner to eliminate any gap between the interconnected workbenches and to maintain them so connected.

It has been found that by fabricating the metal support components from quadrilateral, preferably square tubing, the ends of the quadrilateral tubing may be formed so that one end of one tube slips snugly into the end of an associated tube to tightly and rigidly interconnect the tubes by a wedging action. Additionally, it has been found that by utilizing quick-connect and disconnect fastener assemblies, the workbench surface may be quickly and easily connected or disconnected from supporting structure with minimal use of tools. Accordingly, it is yet another object of the present invention to provide a modular workbench that incorporates these qualities and characteristics.

It is yet another object of the invention to integrate the workbench top as a structural member of the modular workbench so as to preclude swaying, thereby eliminating the necessity of additional anti-sway members and additional ancillary hardware.

It is yet another object of the present invention to provide a modular workbench design incorporating a minimal number of detachably interengaging components that may be individually pre-formed from various composite materials so as to enable packaging and shipment in disassembled form and which may be readily assembled without the use of tools.

A still further object of the invention is the provision of a modular workbench incorporating a rigid workbench top formed from honey-combed synthetic resinous or composite materials having smooth exterior surfaces, integral leg-mounting portions, and leg members that slidably engage the leg-mounting portions so as to retain the workbench top member elevated above a supporting surface such as a floor.

The invention possesses other objects and features of advantage, some of which, with the foregoing, will be apparent from the following description and the drawings It is to be understood however that the invention is not limited to the embodiment illustrated and described since it may be embodied in various forms within the scope of the appended claims.

SUMMARY OF THE INVENTION

In terms of broad inclusion, in one aspect, the simplified modular free-standing workbench of the invention comprises a pair of laterally spaced and parallel workbench-top tubular support members to which the workbench top is rigidly yet detachably secured by quick-connect/disconnect fastener elements. The laterally spaced tubular support members are supported in an elevated attitude by pairs of tubular legs rigidly yet detachably engaging the associated ends of the tubular bench top support members. Additionally, tubular foot members may optionally be rigidly yet detachably engaged with the bottom ends of the leg members, thus providing a facility for selectively varying the height of the workbench top surface merely by varying the length of the foot members. The laterally spaced workbench top support members may be interconnected by transversely extending tubular members that abut the inner confronting surfaces of the tubular laterally spaced top support members, and are attached thereto by simplified quick-connect/disconnect fastener elements.

An auxiliary or ancillary shelf is mounted above the surface of the workbench top by an elongated lateral member similar in its configuration and dimensions to the lateral support members that retain the workbench top member, and is supported in an elevated attitude above the top surface member by a pair of tubular auxiliary support members rigidly but detachably engaging the lateral member and extending vertically to the work bench top member and which is supported adjacent its rear edge by a pair of elongated tubular members which abut the unconfronted surface of the workbench top lateral support member and are disposed in a vertically extending attitude and engaging a horizontal transverse auxiliary shelf rear support member by simplified quick-connect/disconnect fastener elements to which shelf surface member is secured to the elongated tubular horizontal members by quick-connect/disconnect fastener elements.

To detachably secure one end of an assembled free-standing modular workbench to an associated end of an adjacent similarly assembled free-standing modular workbench, means are provided for interconnecting the tubular support members of one bench to the tubular support members of an associated bench to impose a cinching force that draws the end members of the associated workbenches together to form a continuously maintained and unbroken work surface "line" or series of two or more free-standing modular workbenches.

BRIEF DESCRIPTION OF THE DRAWINGS

FIG. 1 is a perspective view illustrating one embodiment of the free-standing modular workbench in assembled form. Portions of an adjacent workbench and the means for interconnection of plural workbenches are shown connected to opposite ends of the complete modular workbench assembly.

FIG. 2 is a fragmentary horizontal cross-sectional view taken in the plane indicated by the line 2—2 in FIG. 1.

FIG. 2A is a fragmentary elevational view illustrating the compound configuration of the associated leg members of two aligned modular benches, the view being taken in the direction of the arrow 2 in FIG. 1, and showing that with respect to the upper end of each leg, the bottom end is displaced laterally in two directions to provide spacial clearance for the legs.

FIG. 2B is a fragmentary elevational view of the compound leg arrangement shown in FIG. 2A, the view being taken in the direction of the arrow 2B in FIG. 2A.

FIG. 2C is a fragmentary elevational view illustrating the lateral displacement of the lower ends of the legs in two directions, the view being taken in the direction of the arrow 2C in FIG. 2A.

FIG. 15 is a fragmentary elevational view illustrating one of three tubular support members and the tubular auxiliary shelf frame members for supporting the auxiliary shelf in elevated position above the workbench top surface.

FIG. 16 is a perspective view of one of the tubular auxiliary shelf support members that may be quick-connected or disconnected between the auxiliary shelf riser members that support the auxiliary shelf.

FIG. 17 is a perspective view of one of two auxiliary shelf risers used to support the auxiliary shelf in elevated position above the top surface of the workbench.

FIG. 19 is a vertical sectional view illustrating the structure for forming a quick-connect/disconnect union between the support tube members and the workbench top.

FIG. 19A is a fragmentary perpsective view illustrating the quick-connect/disconnect structure of FIG. 19 that is selectively manipulable to detachably secure the workbench top to the underlying elongated support members.

FIG. 20 is a perspective view illustrating in exploded form the structure of the foot sub-assembly and floor glide that is threaded into the bottom of a leg member for supporting the workbench freely on a supporting surface such as a floor.

FIG. 21 is a perspective view of a foot assembly of different size than the foot assembly illustrated in FIG. 20.

FIG. 22 is a perspective view of a third foot assembly that is longer than either of the foot assemblies illustrated in FIGS. 20 and 21, thus enabling selection of the height of the workbench surface to accommodate different work surface heights that might be comfortable to a workperson.

DESCRIPTION OF THE PREFERRED EMBODIMENT

In terms of greater detail, and referring initially to the embodiment of the invention as illustrated in FIG. 1, it will there be seen that the assembled free-standing modular workbench assembly, equipped with an auxiliary or ancillary shelf structure, is designated generally by the numeral 2, and comprises a primary free-standing modular workbench unit designated generally by the numeral 3, and in this embodiment is optionally equipped with an auxiliary shelf structure designated generally by the numeral 4. It should be understood that the primary free-standing modular workbench constitutes a manufacturable unit apart from the auxiliary shelf structure. The latter structure is illustrated here to emphasize the versatility of the free-standing modular workbench for use in many different industrial environments. Use of the optional auxiliary shelf structure increases the efficiency and productivity of a person working at the modular workbench by enabling placement of infrequently used tools and equipment within easy reach. This leaves the surface of the primary workbench free for the unencumbered performance of manufacturing and/or assembly procedures.

Figure 3:
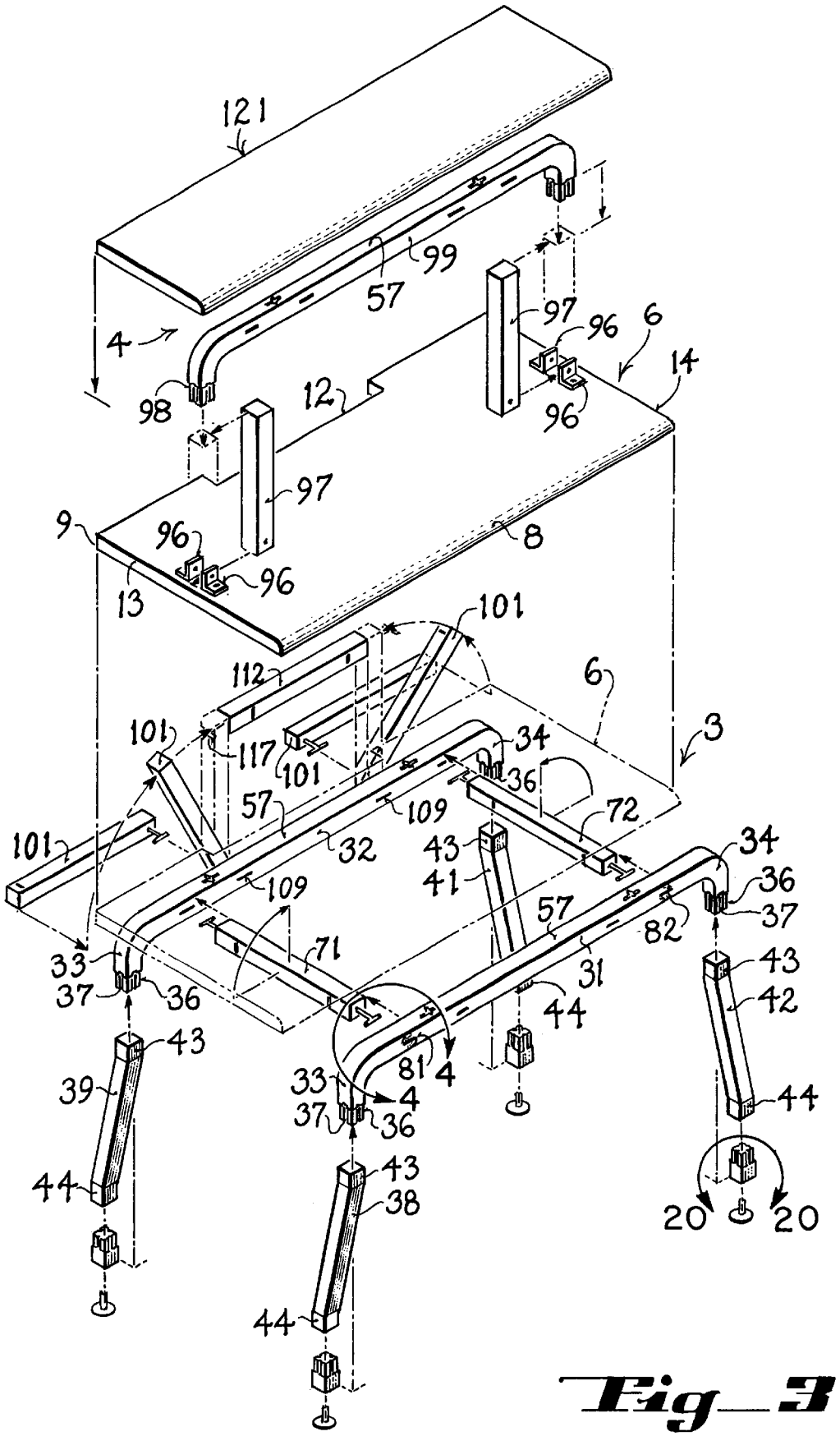
FIG. 3 is a perspective view illustrating the components of a modular workbench in exploded form to better illustrate the cooperative relationship of the various components.

Additionally, illustration of the free-standing modular workbench of the invention in assembled form as in FIG. 1, and in exploded form as in FIG. 3, also emphasizes the simplicity of the completed structure, with or without the auxiliary shelf structure, and emphasizes also the relatively few components that make up the modular workbench assembly, the simplicity and standardization of those components, and the facility with which the modular workbench, with or without the auxiliary shelf, is quickly and easily assembled with only a minimal need of tools as the result of its design and the use of quick-connect and disconnect fastener elements, all of which is explained in greater detail hereinafter.

Referring to FIGS. 1 and 3, and focussing specifically on the primary free-standing modular workbench designated generally by the numeral 3, the primary free-standing modular workbench includes a flat, generally rectangular top member 6 that may be nominally 30" to 36" wide, 48" to 72" long, and which may be conveniently fabricated from high density particle board, plywood, or edge-joined wood planks having a thickness of about 1". These materials are available commercially from many different sources, and provide the desirable thickness to the workbench top to ensure rigidity, and enable quick-connection and disconnection of components of the assembly to the workbench top.

Alternatively, the top member can be formed from extruded plastic, metallic-based structures, laminate-covered rigid ureathane or recycled materials and fabrics which impart high strength, durability and comparatively low weight characteristics to the top member, the top member thus manufactured being susceptible to being transported and handled at less expense and with greater ease than wood or timber-based products. Preferably, as seen in the drawings, the upper surface 7 of top member 6 is smooth and flat and merges smoothly with the front edge 8 of the workbench top which is "rolled", i.e., provided with an arcuate curvature to eliminate sharp edges that might cause injury to a workperson. Additionally, to accommodate the auxiliary shelf structure 4, the rear edge 9 of the workbench top is recessed approximately 2" for a length of about 26" to provide a notch 12 spaced medianly between the left and right end edges 13 and 14, respectively, of the top member 6.

To facilitate quick-connection and disconnection of the workbench top 6 to underlying supporting structure, as will hereinafter be explained, reference is made to FIGS. 1, 3, 18, 19 and 19A of the drawings, where it is seen that the undersurface 16 of the top member 6 is provided with ten circular recesses 17, five each being associated adjacent opposite ends of the top member 6. Each of the recesses extends only partially into the top member and is defined by a recess bottom wall 18 and an inner generally cylindrical peripheral wall 19 dimensioned to snugly receive a quick-connect and disconnect fastener element designated generally by the numeral 21 as seen best in FIGS. 19 and 19A.

As there shown, each of the quick-connect and disconnect fastener elements 21 comprises a generally cup-shaped metal member having a generally cylindrical peripheral wall 22 open at one end 23 that is exteriorly circumscribed by a radially extending integral circular flange 24 adapted to abut against the bottom wall 18 of the recess and to be secured thereto by appropriate screws 26 as shown. The end of the cup-shaped metal member 21 remote from the open end 23 and the flange 24 constitutes a bottom wall designated generally by the numeral 27 that is integral with the generally cylindrical peripheral wall 22. The bottom wall is formed by two generally arcuate bottom wall portions 28 and 29 that lie on opposite sides of a diametrically extending slot 30 that extends to the inner periphery of the generally cylindrical peripheral wall 22. The slot 30 is defined by spaced parallel edges lying equally spaced on opposite sides of the central axis of the circular cup-shaped member 21. The two arcuate bottom wall portions 28 and 29 are inclined or "ramped" in opposite directions for a purpose which will become apparent hereinafter.

To support the workbench top member 6 in an elevated condition, there is provided a metal support frame sub-assembly the components of which are illustrated in FIG. 1 (assembled) and in FIG. 3 in exploded form for clarity. The metal support frame sub-assembly includes a pair of longitudinally extending laterally spaced tubular metal front and rear main beams 31 and 32, respectively, configured substantially identical, each formed conveniently from approximately 2" square metal tubing approximately 80" in overall length. Obviously, other quadrilateral configurations and appropriate dimensions may be used without departing from the spirit of the invention. For convenience in referring to these main beams, the beam 31 will be referred to as the "front" beam since it is associated adjacent to and parallel to the front "rolled" edge 8 of the bench top 6, while beam 32 will be referred to as the "rear" beam since it is associated adjacent to and parallel to rear edge 9 of top 6.

Each main beam, at opposite ends, is bent to provide integral parallel leg-mounting extensions 33 and 34 that extend approximately 6" perpendicular to the main body of the beam on which they are formed. Adjacent their ends remote from the beam, each leg-mounting extension is provided with a swaged or crimped portion 36 having a length of approximately 2" by forming an elongated groove 37 medianly in each of the four sides of the square tubing as shown. The swaging or crimping is accomplished with a forming tool that suitably dimensions the tubular portion 36 of the extension portions 33 and 34 to snugly extend telescopically into the upper interiors of associated leg tubes of which there are four designated respectively by the numerals 38, 39, 41 and 42.

It should be noted that the four leg tubes are identical, each conveniently fabricated from approximately 2" square metal tubing, and each formed with a tubular socket portion 43 at its upper end and a tubular socket portion 44 at its lower end. The upper socket portion 43 of each leg tube snugly and telescopically receives the associated formed portion 36 of an extension portion 33 or 34, each socket portion 43 thus rigidly retaining a leg tube detachably secured to one end of the main beam with which it is associated. Each of the leg tubes is jogged laterally between the upper socket portion 43 and the lower socket portion 44, so that the central axes of the two tubular socket portions on opposite ends of a leg tube are not axially coincident, i.e., the lower socket portion 44 is laterally offset from the upper socket portion 43 by at least the transverse dimension of the tube from which it is fabricated, i.e., at least 2". The effect of this logged leg tube configuration is illustrated in FIGS. 1 and 2, where it is seen that the leg tubes 38 and 42 of two workbenches arranged end-to-end may be secured to the associated formed portions 36 so that the lower end socket portions of the leg tubes are laterally offset from one another, thus enabling the four lower socket portions 44 of the associated legs of the two tables to be coincident in a common transverse plane. This further enables multiple workbenches to be arranged end-to-end without leg interference so that the end edges of the top members may abut, thus eliminating a gap between the aligned workbenches.

To enable the height of the free-standing modular workbench to be adjusted, foot members 46, 47, 48 and 49 are provided for snug telescoping detachable engagement in the lower sockets 44, respectively, of leg tubes 38, 39, 41 and 42, as illustrated in FIG. 1. Each of the foot members comprises a square tubular metal portion 51 (FIGS. 20, 21 and 22) that may have a length of 1", 3" or 5", for instance, with a 2" formed portion 52 integral therewith and adapted to slip snugly, telescopically, and detachably into the associated lower end tubular socket of a leg tube. The end of the tubular portion 51 remote from the formed portion is closed by a metal plate 53 welded or swaged thereto, and a threaded bore (not shown) is centrally formed in the plate to adjustably receive the threaded shank 54 of a disk 56 that also functions as a floor glide. Each of the adjustment disks may be adjusted individually by threading it into or out of the metal plate to level the bench top 6 despite uneveness of the floor on which the workbench is supported.

Figure 18:
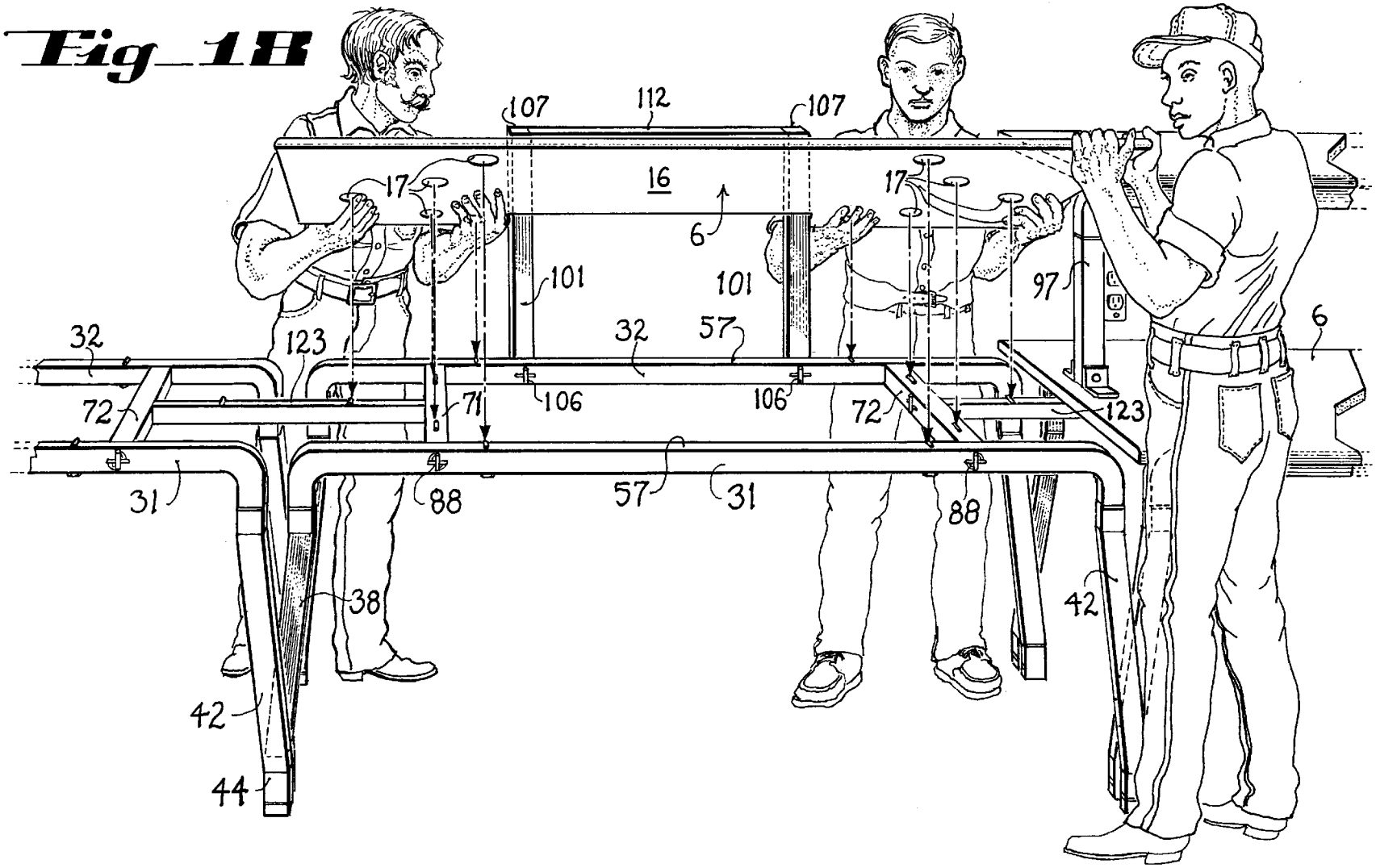
FIG. 18 is a perspective view illustrating the workbench top member being lowered onto the laterally spaced workbench support members.

Previously described has been the manner in which the underside 16 of the workbench top 6 has been prepared by the provision of five spaced recesses adjacent opposite ends of the bench top, and placement of a quick-connect or disconnect fastener element in each of the recesses. These structures are illustrated in FIGS. 18, 19 and 19A. To attach the bench top 6 to the top wall 57 of the elongated front and rear main support beams 31 and 32, respectively, each of these beams, as illustrated in FIGS. 3, 6, 8, 18, 19 and 19A, is provided on both its upper top wall 57 and its lower bottom wall 58 with elongated vertically aligned slots 59 and 61 (FIG. 8), respectively, adjacent opposite ends of the beam.

Figures 6, 7, 8:
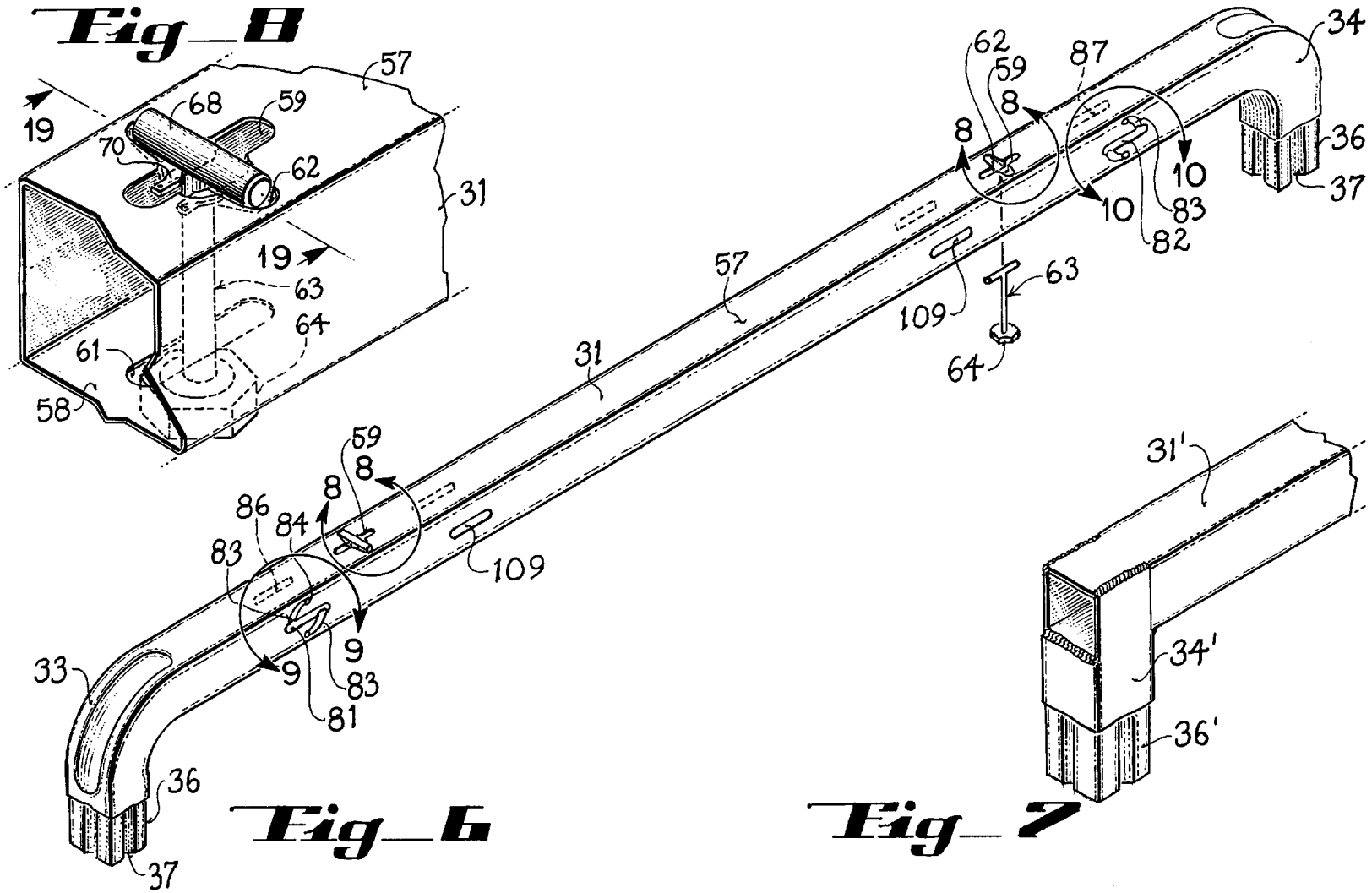
FIG. 6 is a perspective view of one of the three elongated tubular support members shown apart from other structure for clarity.
FIG. 7 is a fragmentary elevational view illustrating a welded leg mounting extension in lieu of the bent leg mounting extensions shown in FIG. 6.
FIG. 8 is a fragmentary elevational view illustrating a quick-connect and disconnect fastener assembly in the form of a detent for detachably receiving a captivated T-bolt retained by a spring steel C-clip.

Each of the elongated slots 59 and 61 extend longitudinally of the top wall 57 and bottom wall 58 in which they are formed one above the other, each being approximately one-quarter of an inch wide and approximately one and three-quarter inches long. Associated with each of the slots 59 in the top wall 57 is a transversely extending elongated depression 62 that is intercepted by the laterally space side edges of the slot 59. Aligned depresion portions thus extend transversely and perpendicularly on opposite sides of the slot 59 as shown in FIG. 8. Referring to FIG. 19, the top wall portion 57 that is recessed on opposite sides of the slot 59 is illustrated and designated by the numeral 57'.

The purpose of the slots 59 and 61, and the recesses 62, are to accommodate a quick-connect/disconnect member designated generally by the numeral 63 (FIGS. 6, 8 and 19) which comprises a head member 64, conveniently hexagonal and threadably mounted on the threaded end 66 of a spindle 67 that extends through the lower slot 61 and is provided at its upper end with a transversely extending lock rod 68 that is welded fixedly to the upper end of the spindle 67. The lock rod 68 is dimensioned to pass freely through the slot 59 in the top wall 57, the spindle 67 being of sufficient length to enable the placement of a washer 69 between the head 64 and the bottom wall 58 of the support member, and a spring clip 70 (FIG. 8) between the lock rod 68 and the top wall 57 following initial mounting of the T-bolt 63 on the beam.

This detachably locks the quick-connect/disconnect fastener element 63 to the tubular support member 31 or 32 and enables rotation of the spindle and the lock rod 68, which is initially aligned with the elongated slot 30 (FIG. 19A) formed in the bottom wall 27 of the complementary fastener element 21 attached to the underside of the bench top. The elongated head 68 may be rotated so that the end portions thereof climb the ramp segments 28 and 29 as seen in FIG. 19A, so as to pull the washer 69 against the underside of the bottom wall 58, to thus tightly cinch the underside of bench top member 6 to the top wall 57 of the underlying support member 31 or 32.

Since this quick-connect/disconnect structure is replicated in each of the ten recesses equipped with a quick-connect/disconnect cup member 21, in the interest of brevity in this description, only the one quick-connect/disconnect fastener element illustrated in FIGS. 19 and 19A is described, it being understood that the structure and method of its operation and its purpose as described above applies to each of the other locations where this structure is used. It will thus be seen that by manipulation of the spindle 67 associated with each of these quick-connect/disconnect fastener elements, referred to also as T-bolts, the bench top 6 is securely yet detachably fastened to the two laterally spaced support beams 31 and 32, the transverse members 71 and 12 and the interconnect members 123 as will hereinafter be explained.

To insure that the beams 31 and 32 remain in spaced parallelism, square tubular transverse beams 71 and 72 are detachably disposed perpendicularly therebetween. Each beam 71 and 72 is approximately 22 inches long and closed at both opposite ends by plates 73 welded or otherwise secured to the ends of the beams. Each of the plates is provided with a T-bolt designated generally by the numeral 74. Each T-bolt includes a stem 76 one end of which is centrally secured to the associated plate 73, and the opposite distal end of the stem 76 spaced therefrom approximately 2"

has positioned transversely thereacross a lock rod 77. Also formed in each of the transverse beams 71 and 72 are elongated slots 78 spaced inwardly from each opposite end and formed with a transverse recess 79 as previously described in connection with the structure illustrated in FIG. 8.

In this instance, referring to FIG. 16, each slot 78 is provided with a companion slot (not shown) that is aligned with the slot 78 but is formed in the lower or opposite wall of the tubular member 71. As described with respect to FIGS. 6, 8, 19 and 19A, the purpose of the slots 78 and the companion slots in the lower wail of the tubular member 71 is for the same purpose as described previously, namely, to receive the quick-connect/disconnect fastener elements 63 so as to enable detachable securement of the bench top 6 to the transversely extending beams 71 and 72. These connection means in the transverse beams 71 and 72 thus account for four of the ten connection means illustrated for application to the underside 16 of the bench top 6 as illustrated in FIG. 18.

Figures 9, 10:
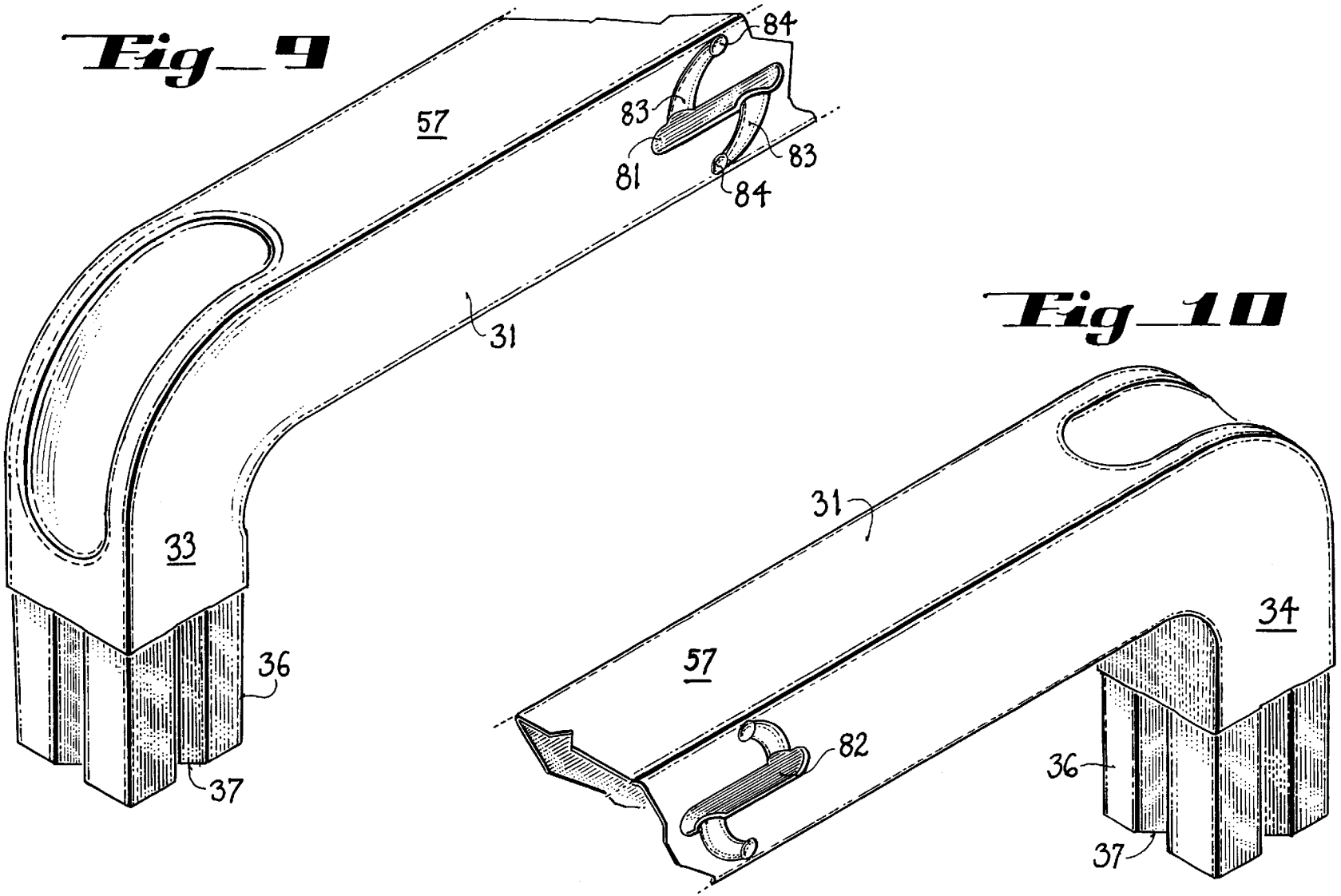
FIG. 9 is a fragmentary elevational view of one end portion of a tubular support member as illustrated in FIG. 6, and illustrating the detail of a T-bolt interconnecting slot.
FIG. 10 is a fragmentary perspective view of the opposite end of the tubular support member shown in FIG. 9, and illustrating the detail of a T-bolt interconnecting slot.

To secure the transverse beams 71 and 72 between the confronting surfaces of the main beams 31 and 32, each of the main beams 31 and 32 is provided with pairs of longitudinally extending slots 81 and 82 (FIGS. 6, 9 and 10) with each slot 81 and 82 being associated with arcuate recesses or channels 83 that commence adjacent opposite ends of the slot 81 and progress clockwise on opposite sides of the central axis of the slot 81 to terminate in detent recesses 84 at each opposite end remote from the slot. With respect to the slot 81, the arcuate recesses or channels 83 progress clockwise about a central axis of the slot. However, with respect to the slot 82 associated with the opposite end of the support beam 31, it should be noted that the arcuate recesses or channels 83 are associated with opposite ends of the slot 82 and that the arcuate recesses progress counter-clockwise on opposite sides of the slot about a central axis of the slot 82. The change of direction of channels 83 at opposite ends of the beam 31 enables the front and rear beams 31 and 32 to mirror the ramps associated with the slots to support interchangeability of transverse beams 71 and 72. It should also be noted that each of the slots 81 and 82 is provided with a companion slot 86 and 87, respectively, formed in the far or opposite wall of the beam 31 as illustrated in FIG. 6.

Figure 4:
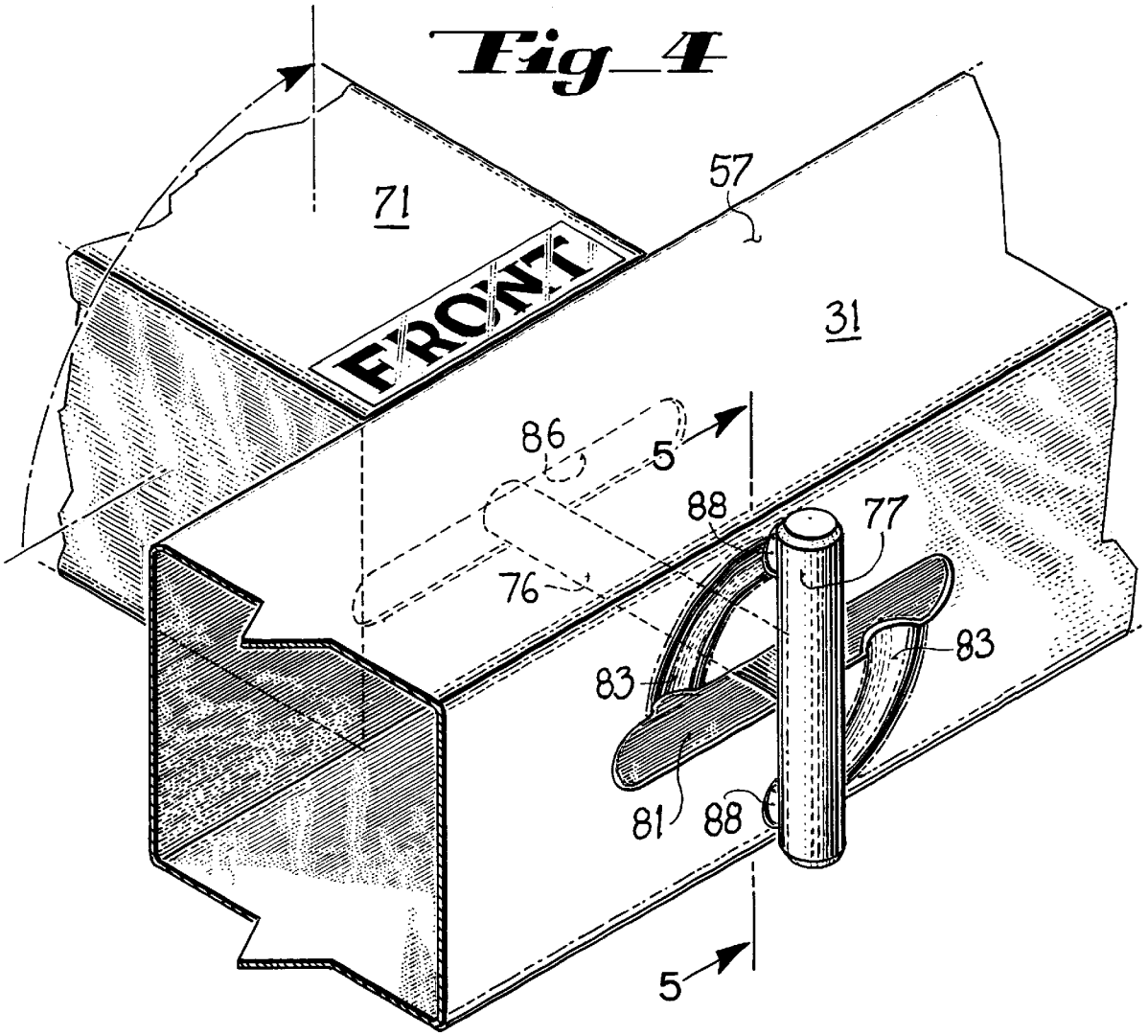
FIG. 4 is a fragmentary perspective view illustrating two perpendicular frame members detachably interconnected utilizing a quick-connect and disconnect fastener assembly in the form of a ramp and T-bolt assembly shown in locked position.
Figure 5:
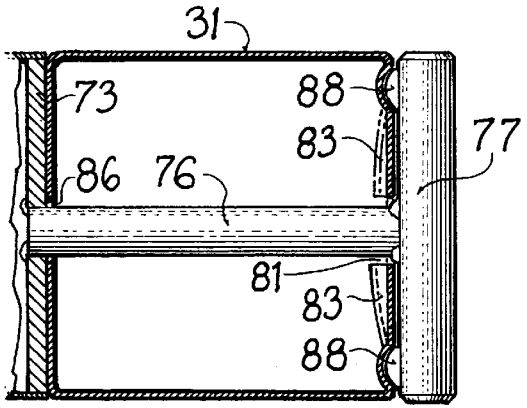
FIG. 5 is a fragmentary vertical cross-sectional view taken in the plane indicated by the line 5—5 in FIG. 4.

Referring to FIG. 3, it will thus be seen that the transverse beams 71 and 72 may be associated with the main beams 31 and 32 as there shown, and each of the T-bolts 74 inserted through the aligned slots 86/81 and 87/82 with respect to the main beam 31, and corresponding slots in beam 32 to thus mount the transverse beams on the main beams. Once the heads or lock rods 77 of the T-bolts 74 and 76 have penetrated through the main beams 31 and 32. The transverse beam 71 is rotated clockwise as indicated by the arrow in FIG. 3, thus causing the T-bolt to rotate, causing the head 77 to assume the position illustrated in FIG. 4, and the detent lugs 88 formed on the heads 77 adjacent opposite ends, to follow the arcuate channel 83 and ultimately drop into the detent recesses 84. Each T-bolt thus lies detachably locked in place, and the effect of rotating the transverse beam 71 through 90 degrees as illustrated by the arrow in FIGS. 3 and 4, causes the transverse beam 71 to be cinched tightly against the confronting surfaces of the two laterally spaced and parallel main beams 31 and 32. It will of course be understood that the same quick-connect/disconnect action occurs between the T-bolt on the opposite end of the beams 71 and 72 with respect to the main beam 32. Referring to beam 72, it should be noted that this transverse beam is rotated counter-clockwise to effect locking of the T-bolts with the beams 31 and 32.

Figures 11, 12, 13, 14:
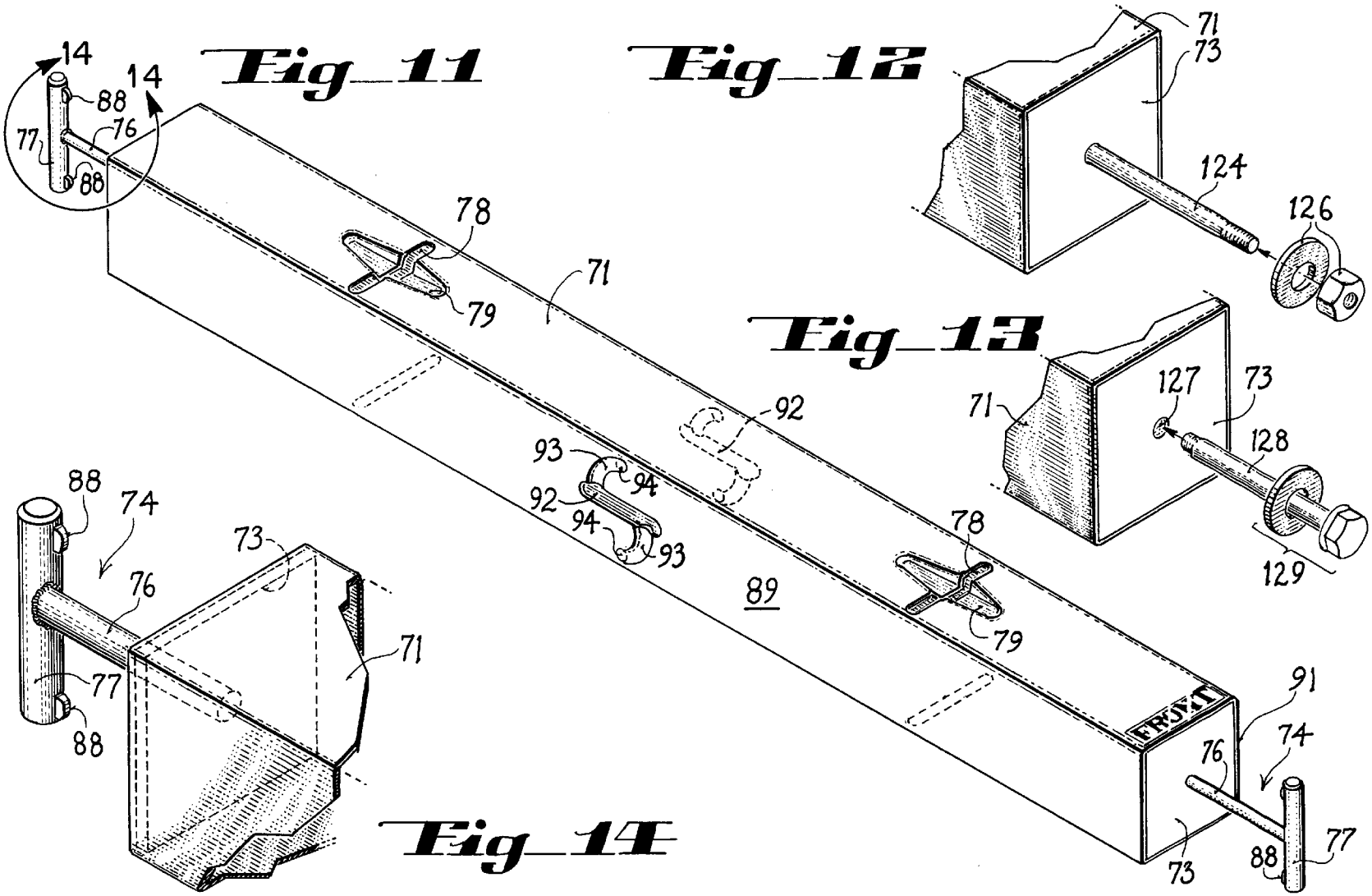
FIG. 11 is a perspective view of one of the tubular transversely extending reinforcing tubes illustrating quick-connect and disconnect slots for receiving captivated T-bolts and T-bolts welded to and extending from opposite ends of the tube for engagement as shown in FIG. 4.
FIG. 12 is a fragmentary perspective view of an alternate construction of the end of the transversely extending tubular reinforcing members, illustrating a threaded stud and nut assembly as distinguished from the T-bolt arrangement shown in FIG. 11.
FIG. 13 is a fragmentary perspective view illustrating a second alternate embodiment of the quick-connect/disconnect means, illustrating a threaded bore in the end plate of the transverse tube, with a threaded bolt with washer adapted to be threadably engaged in the threaded bore.
FIG. 14 is an enlarged fragmentary perspective view of the quick-connect and disconnect structure in FIG. 11 enclosed by the arrow line 14—14.

Comparing FIGS. 4, 5, 8 and 11, it will be seen that once the T-bolts of transverse support beams 71 and 72 are inserted through the slots 81 and 82, and the transverse beams rotated through 90 degrees as indicated by the arrows in FIG. 3, the lock rods 77 move into a position that is transverse to the associated surface of the main beams 31 and 32. Having been rotated into this locked position between the main beam 31 and 32, each of the transverse beams 71 and 72 exposes on its upper surface the slots 78 through which the quick-connect/disconnect member 63 may be inserted through slot 78 companion slot for quick-connection/disconnection with the complementary quick-connect/disconnect fastening elements 21 embedded in the recesses 19 formed in the underside 16 of the workbench top 6. Additionally, in each of the transverse support beams 71 and 72 when in installed orientation as illustrated in FIG. 11, there is exposed on the vertical surface 89 of each transverse beam and on its opposing surface 91, a longitudinally extending slot 92 from each opposite end of which extend arcuate channels 93 as previously described, each having detent recesses 94 in their ends remote from the slots 92. The purpose of these slots and these arcuate recesses has been discussed herein. The foregoing describes the primary free-standing modular workbench apart from other optional embellishments.

Referring to FIGS. 1, 3 and 15–17, it will be seen that mounted on the top surface of the workbench top 6 associated with each opposite end, and equally spaced on opposite sides of an elongated center line through the workbench top 6, are pairs of confronting angle brackets 96, and between each pair of which is secured a post member 97 having a length of approximately 22 inches. Each post 97 is fabricated from square metal tubing having an open upper end into which the swaged/crimped end portion 98 (FIG. 3) of a longitudinal auxiliary support beam 99 is inserted so as to releasably secure the auxiliary support beam 99 elevated above the top surface 7 of the workbench top as illustrated in FIG. 1. As previously discussed, the beam 99 may be identical to the support beams 31 and 32 on which the workbench top 6 is supported, being provided with the same pattern of slots for use of quick-connect/disconnect fastener elements as has been discussed above.

As has previously been described the workbench top 6 is provided with a notch 12 in its rear edge 9. The purpose of this notch is to provide clearance for the passage of riser members 101 as illustrated in FIGS. 1, 3 and 17. Each of the riser members 101, of which there are two, is fabricated from approximately 2" square metal tube stock having a length of approximately 22 inches. At one end, here designated the lower end shown to the right in FIG. 17, there is secured adjacent the end 102 of each riser a T-bolt designated generally by the numeral 103 and comprising a stem 104 one end of which is secured to the associated surface of the riser member 101. A lock rod or head 106 (FIG. 17) is secured on the opposite end and extends perpendicular to the stem 104, parallel to the length of the riser member 101, and spaced therefrom about 2".

Adjacent its opposite end 107, each riser member is provided with a pair of transverse aligned companion slots 108 formed in opposite side walls of the tubular member 101 as shown. As illustrated in FIG. 15, the lower end 102 of the riser member equipped with the T-bolt 103 is engaged through the support beam 32 by way of aligned slots 109 formed in the support beam 32 as shown. The riser member 101 is initially associated parallel to the support beam 32 in the manner illustrated in broken lines in FIG. 15 so that the T-bolt assembly projects through the support beam, the lock rod 106 appearing on the near face of the support beam 32. Then, utilizing the stem 104 of the T-bolt as the fulcrum, the riser member 101 is pivoted upwardly as indicated by the arrows in FIG. 15, and the progressively associated alternate positions illustrated for that member until it reaches a vertical position as indicated in broken lines in FIG. 15. In that relationship, the lock rod or head 106 of the T-bolt will now be vertically oriented and extend transverse to the near surface of the support beam 32 on which it impinges as described above.

The riser members 101 are joined at their upper ends 107 by an auxiliary longitudinally extending interconnect support beam 112 that is illustrated in mounted orientation apart from other structure in FIG. 16. In FIG. 1, beam 112 is shown in broken lines in fully mounted orientation, while in FIGS. 3 and 15, the beam 112 is shown in partially mounted orientation. The longitudinal interconnect beam 112 is conveniently fabricated from approximately 2" square metal tube stock and is provided at opposite ends with secured closure plates 113 to each of which is centrally secured a T-bolt assembly designated generally by the numeral 114 and including a stem 116 and a transverse lock rod 117 secured thereto. Additionally, the longitudinal auxiliary support beam 112 is provided with pairs of aligned longitudinally extending slots 118 formed in opposing top and bottom walls of the auxiliary support beam 112 as illustrated in FIG. 16. Associated with each of the slots 118 on the top surface of the auxiliary beam 112 as illustrated in FIG. 16 is a transverse recess 119 for receiving a quick-connect/disconnect fastener.

To attach the longitudinal auxiliary support beam 112 between the risers 101 as illustrated in FIG. 15, the beam 112 is oriented so that the T-bolts 114 pass through the slots 108 in the top end portion of the riser beams 101 (appearing on the far wall). The auxiliary beam 112 is then rotated through 90 degrees as illustrated by the arrow in FIG. 15 so that the lock rods 117 on the T-bolts extend longitudinally on the far sides of the risers, i.e. transverse to slots 108 with recess 119 on the top surface 120 oriented upward so that they may be utilized to attach the auxiliary top shelf 121 to the auxiliary beam 112 and the auxiliary shelf support beam 99 in a manner which will now be explained.

Referring to FIG. 1, it will be seen that the auxiliary shelf 121 is provided on its underside (not shown) with four recesses 122 which accommodate quick-connect/disconnect fastener elements which may be similar to the fastener element 21 illustrated in FIG. 19, but which may be of different design. With such quick-connect/disconnect fastener elements mounted to the underside of the auxiliary shelf 121, complementary quick-connect/disconnect fastener elements similar to the fastener elements 63 illustrated in FIG. 6 may be inserted through the slots 118 and the head or lock rod of the T-bolt engaged in the quick-connect/disconnect fastener element mounted to the underside of the auxiliary shelf in much the same manner as described in connection with the primary workbench top 6. Thus mounted, the auxiliary shelf is positioned approximately 22 inches above the top surface 7 of the workbench top 6 and may be utilized to support ancillary equipment and tools that are not in continuous use, thus leaving the surface of the workbench top free for other manufacturing and assembly procedures.

As has previously been described, one of the advantages of the modular workbench described herein includes the facility by which one of the modular workbenches may be connected detachably yet securely to additional benches at opposite ends of the free-standing modular workbench of the invention. To accomplish this, as illustrated in FIGS. 1 and 18, an interconnect member 123, similar to the auxiliary beam 112 illustrated in FIG. 16 and transverse beam 71 illustrated in FIG. 11, and equipped at opposite ends with T-bolt assemblies 74 of the type illustrated in FIGS. 5, 11 and 14, i.e., having detent lugs 88 is, as previously described, and prior to application of the top member 6, detachably "quick connected" to the associated transverse beam 71 utilizing the quick-connect/disconnect slot 92 illustrated in FIG. 11.

At its opposite end, the extension beam 123 is similarly "quick connected" to the associated transverse beam 72 of the aligned additional modular workbench framework that has been positioned at the end of the primary modular workbench framework prior to application of the top member 6 to the two frameworks. It will be appreciated that the reason this interconnection of the two frameworks must be effected prior to application of the top members 6 is that the interconnect member must be rotated to effect interconnection, and such rotation would not be possible if the top members were secured in place. This arrangement for interconnection of free-standing auxiliary modular workbench assemblies at opposite ends of a primary intermediate workbench assembly is illustrated in FIG. 18.

It will thus be seen that a very sturdy free-standing modular workbench assembly may be assembled from a minimum number of structural members that are prefabricated to moderate manufacturing tolerances so that the components may be easily and quickly assembled to form the assembled free-standing modular workbench. In like manner, additional free-standing modular workbenches may be attached to opposite ends of a primary intermediate free-standing modular workbench so as to extend the working surface to accommodate different processes that might be utilized on adjacent benches during the manufacture, fabrication or assembly of a given article of manufacture.

While the preferred form of the free-standing modular workbench is as described above, and illustrated in some of the drawings, it is possible, referring to FIG. 6, to construct the main support beam 31 (and 32) in the manner illustrated in FIG. 7 rather than in the manner illustrated in FIG. 6. The main difference here is that, as illustrated in FIG. 7, the right angle leg-mounting extension 34' may be a pre-manufactured:unit having a swaged/crimped portion 36', the pre-manufactured unit being welded to the end of the main support beam 31' as illustrated. In all other respects, the function of this alternatively manufactured main support beam is the same as the main support beam illustrated in FIG. 6.

In like manner, referring to FIGS. 12 and 13, in lieu of the T-bolt assembly designated generally by the numeral 74 shown in FIG. 11, in all members which use a T-bolt quick-connect/disconnect fastener device, a threaded stud 124 welded to plate 73 may substitute for the stem 76 illustrated in FIG. 11, and instead of the transverse lock rod 77, the stud 124, threaded at its end remote from the plate, is provided with a washer and nut assembly 126 as illustrated in FIG. 12. Alternatively, as shown in FIG. 13, the plate 73 may be centrally bored and threaded, as at 127, and a stud 128 may be threaded so that the stud threadably engages the metal plate 73, with the opposite end of the threaded stud 128 being provided with an integral head and washer assembly 129 as illustrated.

FIGS. 23 through 27, inclusive, illustrate a second aspect of the invention in that the free-standing modular workbench has been simplified in order to minimize cost and simplify assembly, shipping and storage of the workbench when not in use, or when it must be moved to a new location. In this embodiment of the invention the workbench top member is designated generally by the numeral 131, and comprises a generally rectangular flat body 132 having appreciable thickness, say 1" to 2", for example.

To achieve the characteristics of rigidity and low weight, the flat body 132 that forms the workbench top member is fabricated to include an inner foam-like core member 133 formed from a synthetic resinous material through a process known as "reaction injection molding" in which two or more chemicals that react when mixed are injected into a closed mold. The reaction produces gas (carbon dioxide) and heat, the gas forming and being trapped in a multitude of small cavities surrounded and sealed by polymerized synthetic resinous walls. The molding process also produces a tough "skin" 134 that envelops the rigid foam-like body on all sides as illustrated. The workbench top member thus formed is impervious to most chemicals, including oils, greases and solvents, and is thus ideal as a work surface for assembly of mechanical and electronic gear. It will of course be apparent that other fabrication methods may be used to produce a rigid foam-like core surrounded by a tough "skin" to form the workbench top member. One such fabrication method may include lining the mold's inner surfaces with polymer sheet material prior to closing the mold which, after closing, is charged with polymers that will react to produce the rigid foam-like inner core member. The process results in the inner core member being completely enveloped by the polymer sheet material, with the core member and polymer sheet material inseparably adhering to one another to form a monolithic rigid and inflexible workbench top member.

To support the workbench top member elevated above a supporting floor, elongated tubular legs identical to the leg tubes 38, 39, 41 and 42 illustrated in connection with the workbench 2 illustrated in FIG. 1 are selectively telescopically and detachably engaged with four tubular leg mounting extensions designated generally by the numeral 136. Each tubular leg mounting extension 136 includes an upper end portion 137 and a lower crimped or swaged end portion 138 adapted to be inserted telescopically yet deatachably into the upper open end of an associated leg tube. In the interest of brevity in this description, the leg tubes telescopically attachable to the leg mounting extensions are omitted from the drawing, it being understood that the relationship of the leg tubes with the leg mounting extensions is in all respects similar to the relationship described above with respect to the leg tubes 38, 39, 41 and 42, and the leg mounting extensions 33 and 34 that receive them.

Figure 23:
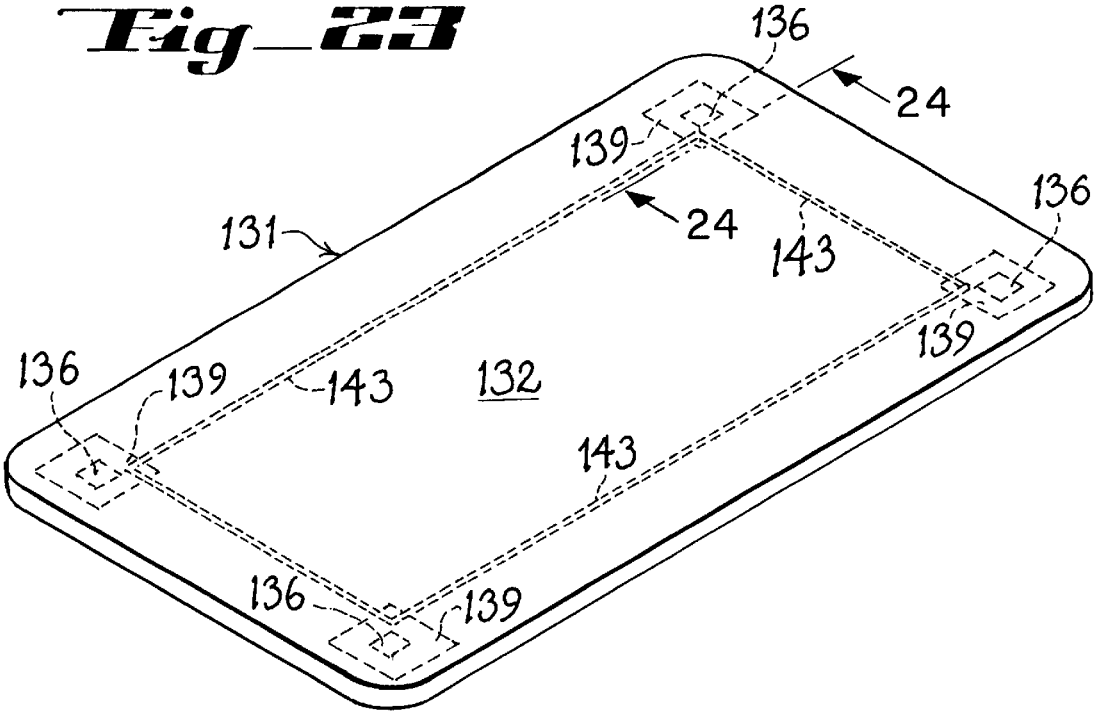
FIG. 23 is a perspective plan view of a second embodiment of a modular workbench top incorporating a tough outer "skin" forming an envelope within which is enclosed a highly rigid yet lightweight foam-like material and from one surface of which project leg mounting portions to which leg members as previously described may be detachably secured.
Figure 24:
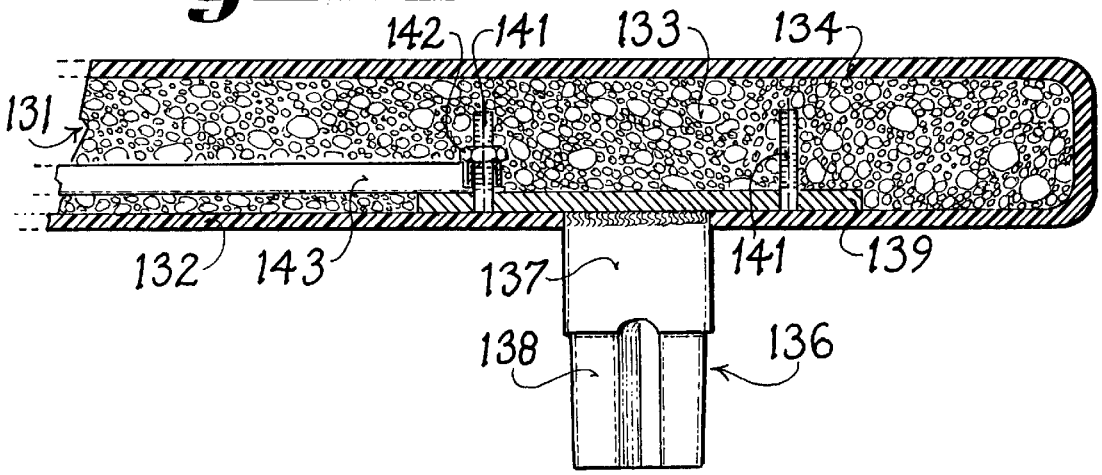
FIG. 24 is a fragmentary vertical cross-sectional view taken in the plane indicated by the line 24—24 in FIG. 23 and illustrating the manner in which the leg mounting portions are secured to the modular workbench top member.
Figure 25:
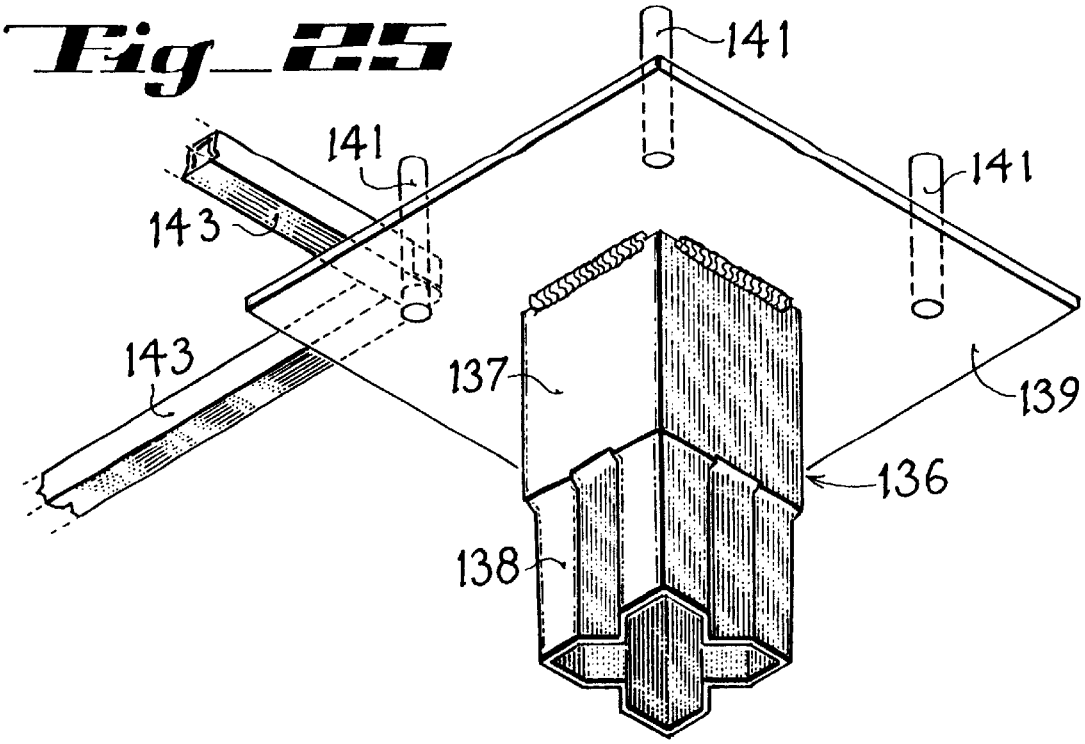
FIG. 25 is a perspective view of the leg mounting portion shown apart from the workbench top member and other structure.

As seen in FIG. 23, four leg mounting extensions 136 are provided, one each being associated with each corner of the workbench top member. Referring to FIG. 24, it will there be seen that the upper end portion 137 is centrally welded to a flat metallic plate 139 that lies embedded within the core member 133, and that the projecting tubular leg tube extends through the "skin" 134. To prevent the plate 139 from shifting laterally within the core member, four pins 141 are provided associated with the four corners of each plate and secured thereto. These pins project into the foam-like core material, being embedded therein, and therefore resist any tendency of the plate to shift laterally from the position in which it is initially embedded in the core material. In FIG. 24, the pins 141 are shown threaded and receive nuts 142 that retain elongated channel-shaped metallic reinforcing members 143 that extend between the plates as shown in FIG. 23. Alternatively, the channel-shaped metallic reinforcing members may be spot-welded at each end to the associated plate to form, collectively, a generally rectangular reinforcing framework that may be dropped into the mold cavity prior to closing and charging with polymers so that the entire reinforcing framework becomes embedded within the body of foam-like material.

Figure 26:
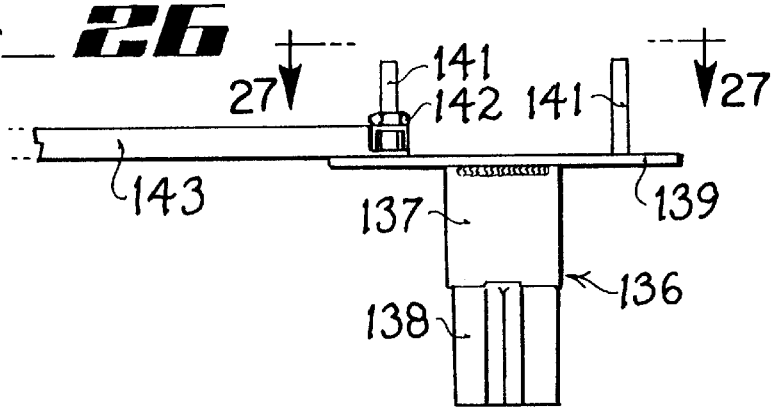
FIG. 26 is a side elevational view of the leg mounting portion apart from other structure.
Figure 27:
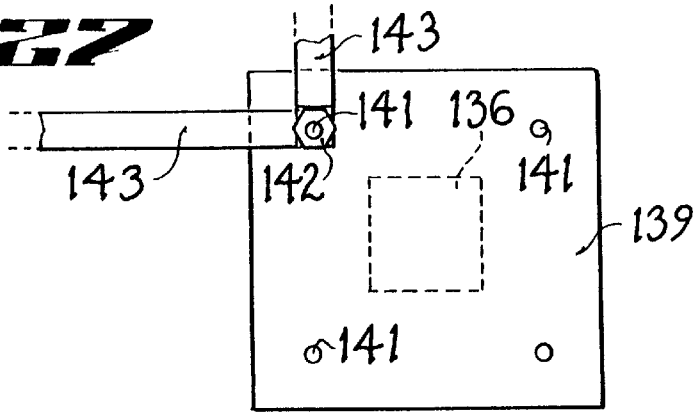
FIG. 27 is a top plan view of the leg mounting portion taken in the plane indicated by the line 27—27 of FIG. 26.

Alternatively, the pins may be smooth as shown in FIG. 26, and stud-welded to the plates, with the associated ends of the reinforcing members spot-welded to the plates as discussed above. In either case, the pins and reinforcing members stabilize and rigidify the workbench top member, and prevent the leg mounting extensions from shifting their position. In this respect, it is noted that the plates, attached pins and reinforcing members all lie embedded within the body of rigid foam-like material, preventing lateral movement of the assembly. Attachment of the plates 139 and leg mounting extensions to one another strengthens the union between the workbench top member and the leg mounting extensions because the upwardly directed reactive force imposed on the core member by each leg tube to counter gravitational forces is distributed over a relatively large area by the plate.

Thus, as with the embodiment of the modular workbench 2 illustrated in FIG. 1, which may be disassembled for shipping, the modular workbench shown in FIGS. 23–27, associated with detached leg tubes as previously discussed in connection with FIG. 1, may be packaged and shipped in "kit" form in a relatively small container, thus enabling the shipment of large numbers of "kits" in a given space. Additionally, because the workbench thus formed, including the detached leg tubes, is so light in weight, the cost of shipping is minimized. When delivered to a manufacturing facility, it will be seen that many modular workbenches may be stored in a relatively small space pending assembly, and that such assembly may be accomplished in minimum time, without the need for tools, thus further saving cost to the ultimate consumer.

Having thus described the invention, what is believed to be new and novel and sought to be protected by letters patent of the united states is as follows.

I claim:

1. A free-standing modular workbench for use individually or optionally in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections detachably mounted on said workbench top member in cooperative association with said bottom surface thereof for detachably receiving a plurality of elongated leg members;

c) a plurality of elongated leg members each having upper and lower ends, said upper ends being detachably received by said leg receiving sections detachably mounted on said bottom surface to retain said top member elevated above said workbench support surface;

d) said means comprising a plurality of leg receiving sections also including a pair of elongated laterally spaced main support beams detachably mounted to the bottom surface of said workbench top member and connected at each opposite end to a leg receiving section;

e) a pair of longitudinally spaced transversely extending spacer beams detachably engage corresponding confronting end portions of said elongated laterally spaced main support beams adjacent said leg receiving sections to retain said laterally spaced main support beams in spaced parallelism; and f) a tubular interconnect-beam is detachably interconnected medianly between a transverse spacer beam of a first modular workbench and a corresponding transverse spacer beam of a second modular workbench arranged end-to-end with said first modular workbench to detachably interconnect said first and second modular workbenches.

2. The free-standing modular workbench according to claim 1, wherein a quick-connect/disconnect assembly is cooperatively interposed between two longitudinally aligned workbench top members and including a tubular interconnected beam detachably interconnecting said transversely extending spacer beams on said two longtitudinally aligned modular workbenches.

3. A free-standing modular workbench for use individually or optionally in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections mounted on said workbench top member in cooperative association with said bottom surface for receiving a corresponding plurality of elongated leg members;

c) a plurality of elongated leg members each having upper and lower ends, said upper ends being detachably received by said leg receiving sections mounted on said bottom surface to retain said top member elevated above said workbench surface;

d) wherein said means comprising a plurality of leg receiving sections for receiving a plurality of elongated leg members includes a pair of elongated laterally spaced main support beams detachably secured to the bottom surface of said workbench top member and connected to pairs of said leg receiving sections;

e) wherein said elongated laterally spaced main support beams are formed from metallic tube stock, and a plurality of quick-connect/disconnect fastener assemblies are cooperatively interposed between said pair of elongated laterally spaced main support beams and said bottom surface of said workbench top member; and f) wherein a plurality of recesses are formed in the bottom surface of said workbench top member, and a portion of each said quick-connect/disconnect fastener assembly is secured to said workbench top member within said recesses.

4. A free-standing modular workbench for use individually or optionally in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections mounted on said workbench top member in cooperative association with said bottom surface for receiving a corresponding plurality of elongated leg members;

c) a plurality of elongated leg members each having upper and lower ends, said upper ends being detachably received by said leg receiving sections mounted on said bottom surface to retain said top member elevated above said workbench support surface; and d) wherein said workbench top member comprises a generally rectangular body having a lightweight rigid synthetic resin foam core member enveloped in tough "skin" formed from synthetic resinous material forming top and bottom wall members defining said top work surface and said bottom surface, respectively, each said means mounted on said workbench top member and including a leg receiving section comprising a metallic plate embedded in said foam core member and contiguous with said bottom wall adjacent each interception of said front and rear edges by said end edges, and a tubular crimped leg receiving section secured to each said metallic plate and projecting perpendicularly therefrom through said bottom wall.

5. A free-standing modular workbench for use individually or in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections detachably mounted on said workbench top member in cooperative association with said bottom surface thereof for detachably receiving a plurality of elongated leg members;

c) a plurality of elongated leg members each having upper and lower ends, said upper ends being detachably received by said leg receiving sections detachably mounted on said bottom surface to retain said top member elevated above said workbench support surface;

d) said means comprising a plurality of leg receiving sections also including a pair of elongated laterally spaced main support beams detachably mounted to the bottom surface of said workbench top member and connected at each opposite end to a leg receiving section;

e) said elongated laterally spaced main support beams being formed from metallic tube stock, and a plurality of quick-connect/disconnect fastener assemblies cooperatively interposed between said pair of elongated laterally spaced main support beams and said bottom surface of said workbench top member; and f) said plurality of quick-connect/disconnect fastener assemblies including slotted cup-shaped fastener elements mounted on the underside of said workbench top member and a plurality of T-bolt fastener elements mounted on said main support beams and manipulable to interengage detachably with confronting slotted cup-shaped fastener elements to retain said workbench top member secured to yet selectively detachable from said main support beams.

6. A free-stranding modular workbench for use individually or optionally in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections mounted on said workbench top member in cooperative association with said bottom surface for receiving a corresponding plurality of elongated leg members;

c) a plurality of elongated leg members each having upper and lower ends, said upper ends being detachably received by said leg receiving sections mounted on said bottom surface to retain said top member elevated above said workbench support surface;

d) an auxiliary shelf structure detachably mounted on said modular workbench; and e) a metal support frame including a plurality of quick-connect/disconnect fastener elements are detachably interposed between said auxiliary shelf structure and said modular workbench top member.

7. The free-standing modular workbench according to claim 6, wherein said metal support frame retains said auxiliary shelf structure elevated above the elongated medianly positioned recess in the rear edge of said workbench top member.

8. A free-standing modular workbench for use individually or optionally in cooperative detachable interconnection with one or more like free-standing modular workbenches adapted to stand on a support surface, comprising:

a) a workbench top member having a thickness defined by a top work surface and a bottom surface spaced from said top work surface;

b) means comprising a plurality of leg receiving sections mounted on said workbench top member in cooperative association with said bottom surface for receiving a corresponding plurality of elongated leg members;

c) a plurality of elongated leg members each having upper and lower ends, said upper ends being detachably received by said leg receiving sections mounted on said bottom surface to retain said top member elevated above said workbench support surface; and d) wherein said plurality of elongated leg members are each provided with tubular first and second end portions, said first tubular end portion of each elongated leg member being symmetrical about a longitudinal axis that is coincident with a plane that is laterally offset from and parallel to a plane that includes the longitudinal axis of the second tubular end portion, whereby a third plane coincident with the axis of an intermediate portion of each leg which connects the first and second end portions intersects said first and second laterally spaced and parallel planes coincident with said axes of said first and second end portions at an angle of approximately forty-five degrees.

* * * * *